United States Patent [19]

Eaves

[11] 4,060,964

[45] Dec. 6, 1977

[54] YARN TEXTURING MACHINE

[75] Inventor: Ronald Spencer Eaves, Chapel-en-le-Frith, England

[73] Assignee: Ernest Scragg & Sons Limited, Macclesfield, England

[21] Appl. No.: 672,073

[22] Filed: Mar. 30, 1976

[30] Foreign Application Priority Data

Apr. 1, 1975 United Kingdom ..... 13252/75

[51] Int. Cl.[2] ..... D01H 1/241; D01H 1/28

[52] U.S. Cl. ..... 57/34 HS; 57/78; 57/105; 74/231 C; 74/242.15 R

[58] Field of Search ..... 57/1 R, 34 HS, 78, 89, 57/92, 102–105, 77.4; 74/231 R, 231 C, 231 CB, 242, 242.3, 242.15 R

[56] References Cited

U.S. PATENT DOCUMENTS

| | | | |
|---|---|---|---|
| 3,021,663 | 2/1962 | Findlow | 57/77.4 |
| 3,686,846 | 8/1972 | Smith | 57/34 HS |
| 3,802,176 | 4/1974 | Stahlecker | 57/105 |
| 3,807,158 | 4/1974 | Landwehrkamp et al. | 57/105 |
| 3,878,672 | 4/1975 | Kohler | 57/104 X |

FOREIGN PATENT DOCUMENTS

| | | | |
|---|---|---|---|
| 635,693 | 3/1962 | Italy | 74/231 C |

*Primary Examiner*—Richard C. Queisser
*Assistant Examiner*—Charles Gorenstein
*Attorney, Agent, or Firm*—Michael J. Striker

[57] ABSTRACT

Each station of a row on a multistation yarn texturing machine comprises a common support unit for all driven members of that station, the driven members being interconnected for synchronous operation by a transmission system which includes a coupling member such as a toothed belt, and the support unit being movable for engaging or releasing the coupling member from a single machine drive member common to all the stations of a row and preferably consisting of a shaft with toothed wheels for driving the coupling members.

9 Claims, 5 Drawing Figures

YARN TEXTURING MACHINE

Figure 1:
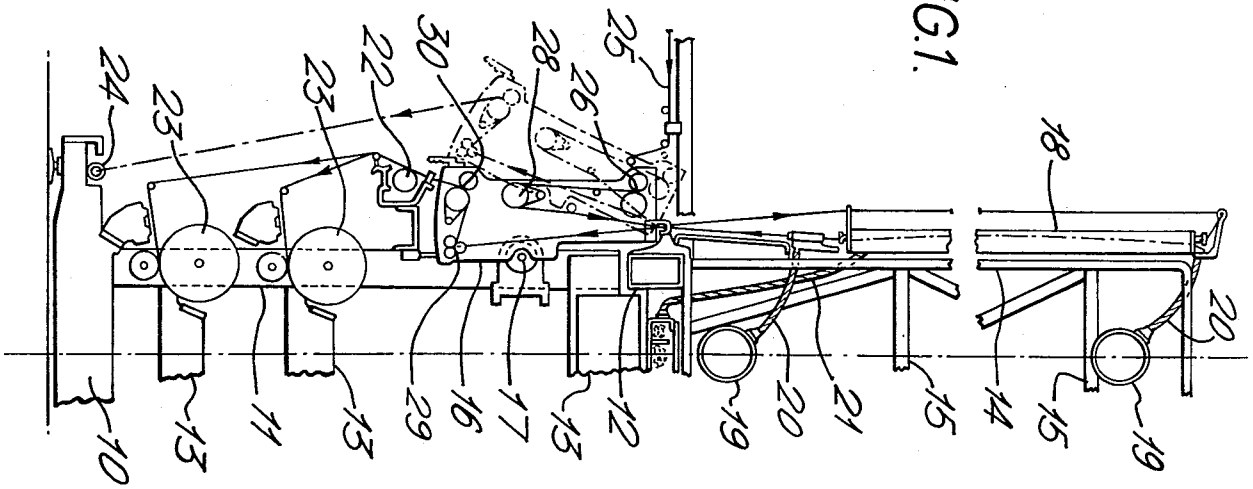

This invention relates to a yarn texturing machine of the kind in which yarns from supply packages run through texturing zones under the control of driven members operating as rotating forwarding means such as nip rolls, feed capstans, or apron feeds. A texturing zone may be of the kind which effects false twist crimping of yarn, for example the texturing zone may comprise a heating zone, a cooling zone, and a false twisting device in that order, the device itself being another driven member such as a false twist spindle or a friction false twister, or alternatively the texturing zone may include or consist of a fluid jet yarn bulking device.

Known devices comprise multiple processing stations at each of which one or more yarns are textured, and usually the machines are double-sided, having a row of stations at each side. Thus the machine textures many yarns simultaneously, and each station has driven yarn forwarding members such as infeed rolls, intermediate rolls, delivery rolls, and in some cases draw rolls when the feed yarn is undrawn or only partially drawn and the yarn is being drawn as well as being textured. The drawing step may occur immediately before texturing or may occur simultaneously with texturing. Also in known machines it is usual to have a main drive motor and gearbox at one end of the machine, from which drive is transmitted to the yarn forwarding means of the multiple stations as by several parallel shafts running along the length of the machine, and usually at various levels where such as infeed rolls, intermediate rolls and delivery rolls are located. Similarly, drive to false twist devices of the individual stations is usually transmitted by a running endless belt engaging wharves of the devices, the latter usually being movable to engage or disengage their drives. Yarn forwarding rolls have provision for an operator to make them operative or inoperative at will, as when threading up a station for start-up or re-threading after a yarn breakage, and as machine development constantly progresses to provide higher output rates by higher operating speeds, heating and cooling zones become longer and longer, and yarn forwarding roll sets of each station further and further apart with consequential inconvenience to operators working on the machines.

Equally or more important than operator convenience is that machines are required to be operated according to predetermined specifications as to the relative running speeds of yarn forwarding means and false twist devices. For uniformity of quality of textured yarn from an individual station, and for regularity of yarns from all stations, optimum synchronisation has to be aimed for, both within each station and as between all the stations. A gearbox transmitting drive to several parallel shafts, which in turn drive the yarn forwarding means of all stations, and to a flexible endless belt frictionally driving the wharves of false twist devices, falls far short of being a drive system which maintains synchronism. Backlash in gears, which increases with wear, torque in the several shafts, and a flexible friction belt drive to the false twist devices, are all factors which go against maintaining the desired conditions of synchronism.

The object of the present invention is to provide a yarn texturing machine of the kind referred to which is both more convenient for operators, and also achieves high standards in maintaining synchronism within each processing station and as between all stations.

According to the invention, in a multistation yarn texturing machine having at least one row of processing stations, each station includes a common discrete support unit for all drive members of that station, all of which members are interconnected for synchronous operation by a transmission system which includes a coupling member, the coupling member of any transmission system of any station being individually operable to provide that its transmission system is connectable and releasable from a single machine drive member common to a row of processing stations.

Thus by operating the coupling member of a processing station to release its transmission from the machine drive member, all the drive members on the common support unit decelerate to a halt and that station can be serviced much more easily by an operator than hitherto, and similarly by operating the coupling member to re-connect its transmission system with the drive member, all the driven members start up together and remain synchronous as they accelerate up to and finally reach their operating speeds.

In a preferred arrangement the single machine drive member is a shaft common to all processing stations, and for each station provided with a respective toothed timing belt wheel, the driven members on the common support unit being interconnected by having toothed wheels in mesh with toothed timing belts, and one of said belts serving as a coupling member operable to be brought into or out of mesh with a toothed timing belt wheel on the machine drive shaft. In this latter connection the common support unit may be movable, for example pivotally or slidably, to operate the coupling member.

It is envisaged that a coupling member of alternative form is possible, such as a mechanical slipping clutch or a magnetic clutch, but the preferred coupling member is one of the timing belts of the transmission system, engageable with or releasable from the toothed timing belt wheel on the machine drive shaft by bodily pivoting a common support unit having all the driven members thereon and closely adjacent one another.

We have overcome the problem of accelerating the timing belt coupling member, and with it the remainder of the transmission system, up to approximately the same speed as the toothed timing belt wheel on the drive shaft before engaging the teeth of the belt with those of the wheel.

In one arrangement the toothed timing belt wheel is formed, alongside the teeth, with a coaxial plain wheel portion of diameter equal to or preferably slightly greater than the pitch circle of the wheel tooth crests, and the timing belt serving as the coupling member is movable laterally by being entrained over toothed wheels of length at least twice the belt width. Thus the belt can first be moved against the plain portion of the wheel, which accelerates the belt up to speed by the slippable friction contact of one with the other, and then the belt can be moved laterally for its teeth to mesh with those of the wheel. Obviously the belt can be moved away from the wheel, to disengage them, without needing to move the belt laterally.

In another arrangement the toothed timing belt wheel is again formed with a coaxial plain wheel portion, or is coaxial with a plain wheel adjacent to the toothed wheel and on the drive shaft. The coupling member is again a timing belt running over at least two spaced toothed pulleys, and the belt is not movable laterally but lies in the same plane as the teeth of the toothed timing belt wheel on the drive shaft. The support unit which mounts the two spaced toothed pulleys and the timing belt is movable bodily towards and away from the timing belt wheel, so that a span of the belt between the two toothed pulleys is presentable to the teeth on the timing belt wheel. One toothed pulley is carried on a pivot arm biased as by a spring in direction to keep the belt tensioned and coaxial with this toothed pulley and on the same shaft is a friction wheel, such as a wheel with a rubber tyre, which lies in the plane of the plain wheel portion, or the plain wheel, associated with the toothed timing belt wheel on the drive shaft. The friction wheel is of larger diameter than its coaxial toothed pulley, and the plain wheel portion, or the plain wheel, is of slightly larger diameter than the toothed timing belt wheel. When the support unit is moved to operate the coupling member, the friction wheel first contacts the plain wheel portion, or the plain wheel, by which the friction wheel and its coaxial toothed pulley are rotated to accelerate the timing belt up to speed while it is still disengaged from the toothed timing belt wheel. Further movement of the support engages the belt with the wheel teeth and the friction wheel begins to "walk round" the periphery of the plain wheel portion or the plain wheel, the pivot arm of the pulley accommodating this movement and deflection of the belt span from a straight path, by pivoting against the action of its loading spring. Eventually the pivot arm engages a fixed cam member which pivots it still further firstly to lift the friction wheel off the plain wheel portion, or the plain wheel, and secondly to lock the arm against being returned by the spring. Preferably the second toothed pulley is also on a second pivot arm, biased as by a spring in direction to tension the belt. In both the arrangements above described, the timing belt which serves as a coupling member is run up to a speed frictionally faster than that of the toothed timing belt wheel on the drive shaft, so that the teeth align and interengage readily and the belt is subjected only to a slight deceleration rather than an acceleration.

The invention will now be described with reference to the accompanying drawings, in which:

FIG. 1. is an end view depicting one side only of a double-sided yarn false twist crimping machine, and showing one processing station of a row.

Figure 2:
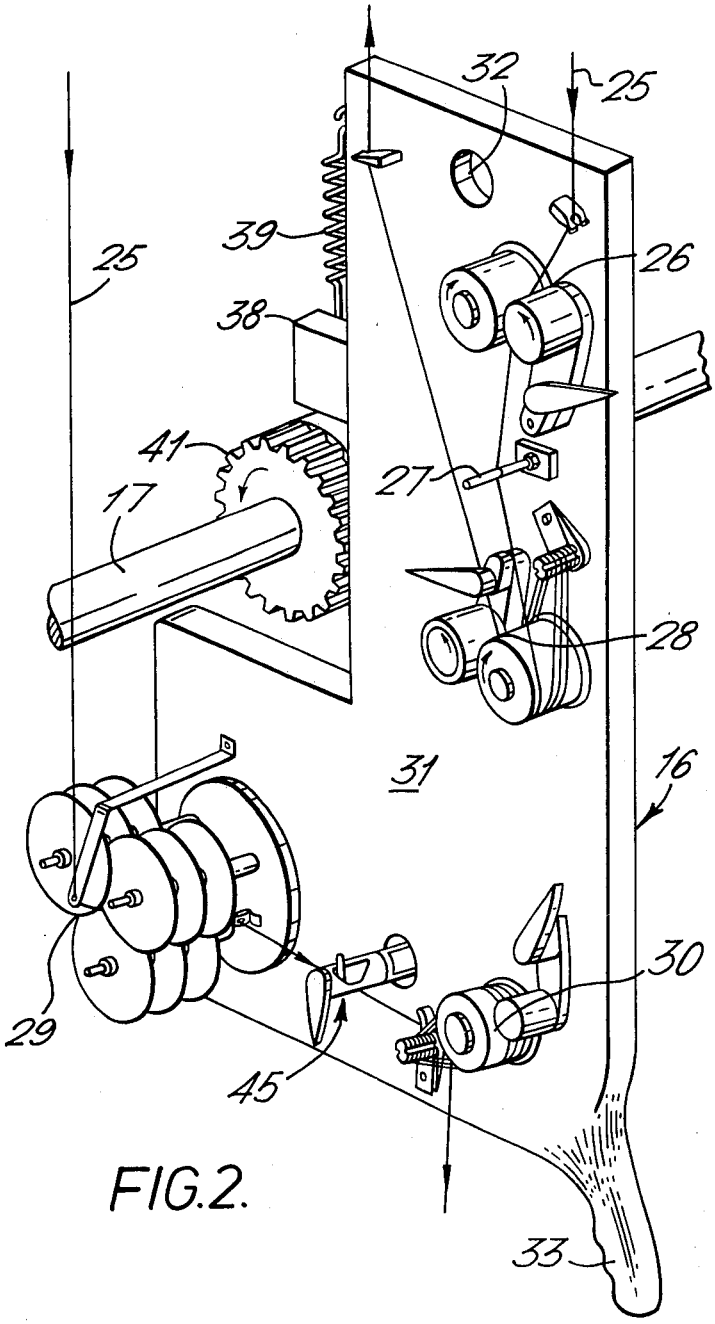

FIG. 2. is an enlarged perspective view, from the front and one side, of a common discrete support unit shown to a smaller scale in FIG. 1., this side of the unit having the driven yarn processing members in closely spaced relationship.

Figure 3:
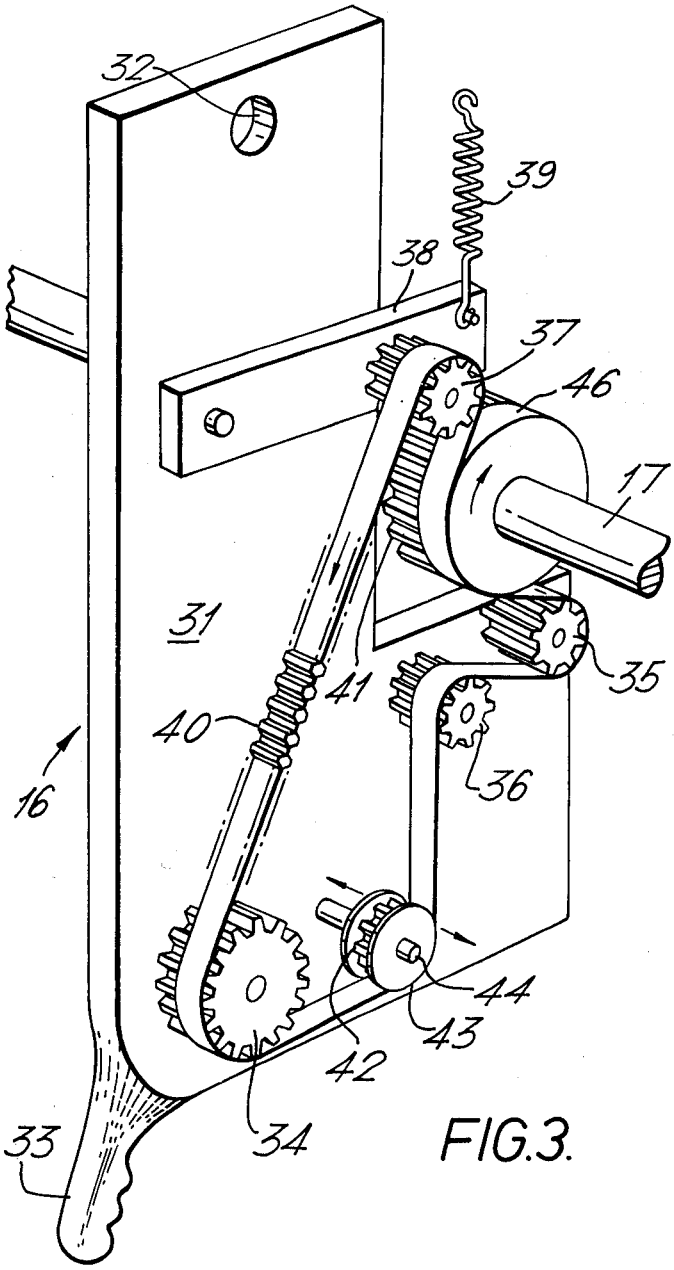

FIG. 3 is a similar view to FIG. 2. of the other side of that unit and showing part of a synchronous drive transmission system, for the yarn processing members, located at this side of the unit.

Figure 4:
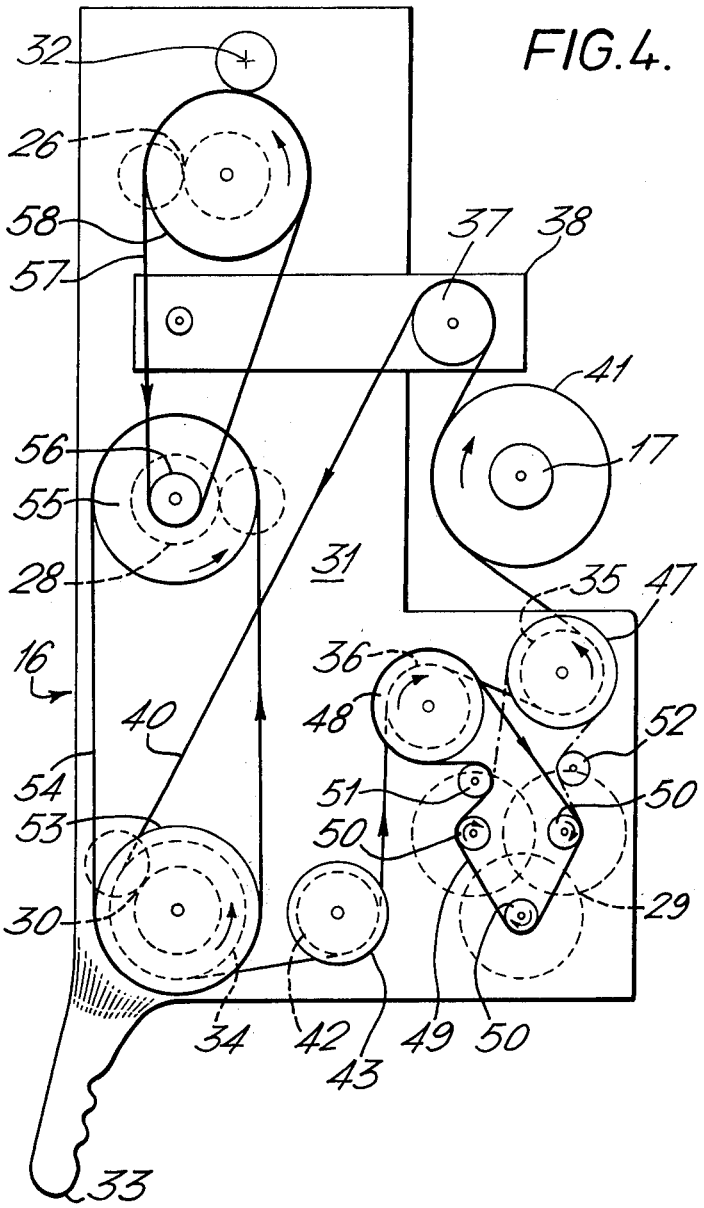

FIG. 4. is a side view of the unit of FIG. 3., and from the same side, but showing the complete synchronous drive transmission system for the yarn processing drive members of FIG. 2.

Figure 5:
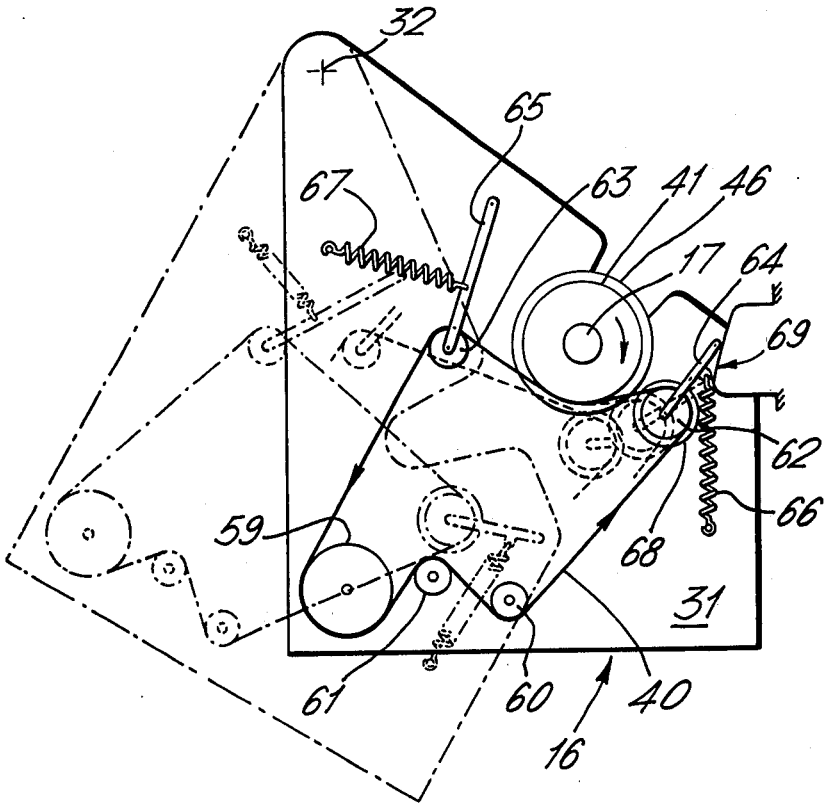

FIG. 5. is a side view of part of an alternative synchronous drive transmission system to that shown in FIG. 3.

Referring to FIG. 1., this end view of one side of a yarn false twist crimping machine shows one processing station of a row of closely spaced stations extending along that side of the machine. This arrangement is quite usual, current machines being available with up to 100 or more stations at each side.

In the machine illustrated, a frame base unit 10 supports frame uprights 11 which in turn support bearers 12, cross-members 13, superstructure uprights 14 and cross-bearers 15. A common discrete support unit, for all driven members of the processing station shown and their transmission system, is indicated generally by the reference numeral 16, and is shown in full lines in its operative position, and in chain-dot lines in an inoperative position in which it is moved bodily away from a single machine drive shaft 17 common to the row of stations. This support unit 16 is at a convenient height for operatives, and besides carrying all the driven members of that station it also carries a transmission system interconnecting all the driven members for synchronous operation, this transmission system including a coupling member which is connected with or released from the machine drive shaft 17 by the action of bodily moving the common support unit into or out of its operative position.

In FIG. 1. the support unit 16 is pivotally mounted at its upper region upon the machine frame bearer 12.

Also shown in FIG. 1., is a yarn heater 18 carried by the machine frame superstructure, vacuum manifolds 19 and intake pipes 20 to both ends of the heater 18 for fume removal, an electricity supply cable 21 to the heater 18, a yarn oiling attachment 22, yarn package winder systems 23, and a suction doffer tube 24 into which yarn is entrained to waste during service operations such as threading up or repairing yarn breaks.

FIG. 1. shows the path of a yarn 25 through the entire processing station while FIG. 2. shows the path of the yarn 25 relative to the driven members on the support unit 16 of the processing station.

Referring both to FIG. 1 and FIG. 2., yarn 25 is forwarded from a supply bobbin on a stand-off creel (not shown) by a conventional feed roll pair 26 on the support unit 16, and from this feed roll pair the yarn runs about a snubber pin 27 (FIG. 2) to a conventional draw roll assembly 28. Thus the yarn is drawn at the snubber pin 27 because the draw rolls rotate faster than the feed rolls. From the draw rolls 28 the drawn yarn runs upwardly via guides to the top end of the heater 18, and then runs downwardly through the heater to a driven false-twist unit 29 on the support unit 16. As seen most clearly in FIG. 2. the false-twist unit comprises sets of overlapping friction discs, but it could be a false-twist spindle or any other yarn crimping or bulking device, whether rotatably driven or not.

As is well-known in the art, twist inserted into the yarn by the false-twist unit 29, upstream of itself is propagated through a cooling zone consisting of the air space between the false-twist unit 29 and the bottom end of the heater 18, and also through the heater 18 which sets the twist in the yarn.

A delivery rolls assembly 30 is on the support unit 16, after the false-twist unit 29 in the yarn travel direction, and from these delivery rolls 30 the textured yarn runs downwardly over the oiling attachment 22 to a package winder system 23 having its own drive arrangement common to the row of stations.

Processing of yarn as above described is known in the art as sequential draw-texturing, the feed yarn being undrawn or partly drawn yarn, drawing of which is effected in the draw zone between the feed rolls 26 and draw rolls 28 before the yarn runs to the texturing heater 18. By omitting the draw rolls 28 and using the delivery rolls 30 as draw rolls, the yarn can be simultaneously draw-textured i.e. drawn on the heater 18 simultaneously with false-twist crimping.

When the feed yarn is fully drawn yarn, draw rolls 28 are again omitted and the delivery rolls 30 are merely operated as such without imparting draw to the yarn.

It will be appreciated from the foregoing description, that in a multistation machine according to this invention, the discrete support unit 16 of each station, carrying all driven yarn forwarding members, transmission system of that station and also a driven false-twist unit, provides a self-contained module which an operator can manipulate easily and with great convenience to himself as regards servicing.

As already stated previously, the transmission system of each support unit includes a coupling member individually operable for connecting or releasing the transmission system from the common drive member provided by the shaft 17.

Referring now to FIGS. 2, 3 and 4 which show the support unit 16 of FIG. 1. to a larger scale, it can be seen that the unit comprises an upright support plate 31 with a hole 32 at its upper region for pivoting it to the machine frame and a handle 33 at one bottom corner. FIG. 2. has already been described and FIG. 3. shows part of a synchronous drive transmission for the driven members of FIG. 2., whereas FIG. 4. shows the complete transmission.

By comparing FIG. 2. with FIG. 3. it can be seen that the delivery rolls 30 are being driven by being on a drive shaft carrying a toothed wheel 34, and that the false twist unit 29 is being driven from one or other of two further toothed wheels 35 and 36, as will be explained later. Another toothed wheel 37 is an idler and jockey wheel, and is carried on a pivot arm 38 loaded by a spring 39 to tension a double-sided toothed timing belt 40 entrained over these toothed wheels and therefore interconnecting them and their associated driven members for synchronous operation.

The machine drive shaft 17 carries, for each support unit 16 of each processing station, a toothed timing belt wheel 41, in co-operation with which the belt 40 serves as a coupling member, operable to connect or disconnect the transmission system of the support unit 16 to or from the drive shaft 17 by pivoting the support plate 31 bodily about the pivot point 32.

When the support unit 16 is pivoted outwardly of the machine frame to the inoperative position shown in chain dot lines in FIG. 1., the toothed belt 40 is moved out of mesh with the toothed timing belt wheel 41, and the span of the belt between the toothed wheels 35 and 37 is straight, due to the spring-loaded pivot arm 38 with its jockey wheel 37. The toothed wheels 34, 35, 36 and 37 are all at least twice as long as the width of the belt 40, which therefore can be moved laterally along the wheels. The belt 40 is also entrained over a toothed belt-shifter wheel 42 with side flanges 43, the wheel 42 being freely rotatable on a shaft 44 which can be moved endwise, to shift the belt 40 laterally, as by a cam and lever mechanism shown diagrammatically at 45 in FIG. 2.

Before the support plate 31 is pivoted in direction to engage the belt with the rotating toothed timing belt wheel 41, the belt is shifted laterally to the position shown in FIG. 3., so that the belt is aligned with a plain portion 46 alongside the teeth of wheel 41. This plain portion 46 is at least of diameter equal to the pitch circle of the teeth tips, but preferably is of slightly greater diameter. As the support plate 31 is pivoted towards the wheel 41, the belt 40 engages this plain portion 46 and the belt commences to be driven, by friction and with initial slipping which progressively reduces, until the belt, the transmission system and the driven members are brought up to their operating speeds. When the plain portion 46 of the wheel is of slightly larger diameter than the pitch circle of the teeth tips, the belt 40 when driven by the plain portion 46 is travelling slightly faster than the toothed portion of the wheel 41, so that the belt teeth are always moving into alignment with the spaces between the wheel teeth, in synchromesh fashion. When the cam and lever mechanism is operated to move the toothed belt-shifter wheel 42 laterally in the appropriate direction, the belt is also moved laterally off the plain portion 46 and laterally into mesh with the teeth of wheel 41. Since the belt is moving slightly faster than the wheel teeth, any slight engagement shock is due to deceleration of the belt 40 and not acceleration, which is desirable.

Referring now to FIG. 4., the complete synchronous transmission is shown diagrammatically in relation to the driven members 26, 28, 29 and 30 of FIG. 2., which are also seen in dotted lines in FIG. 4. The toothed timing belt wheel 41 on machine drive shaft 7 is also shown in FIG. 4., and also the toothed belt 40 which serves as the coupling member of the transmission with the wheel 41. Belt 40 is driving toothed wheels 35 and 36 in opposite directions. Coaxial with wheel 35 and rotating with it is a larger toothed wheel 47, and a similar larger toothed wheel 48 is coaxial with and rotates with wheel 36. A timing belt 49 couples toothed wheel 48 with toothed wheels 50 which drive the shafts of the friction discs of false-twist unit 29 all in the same direction, i.e. clockwise as seen in FIG. 4. An idler wheel over which the belt 49 also runs is shown at 51. When it is desired to reverse the direction of rotation of the shafts 50 of friction discs false-twister 29, the belt 49 is removed from the wheel 36 and placed in the wheel 35 as indicated in chain-dot lines, a second idler wheel 52 then being brought into use. This arrangement provides that the false-twister can apply either S or Z twist to the yarn. Belt 40 also runs over toothed wheel 34 to rotate the delivery rolls 30, and coaxial with wheel 34 and rotating with it is a larger toothed wheel 53 over which runs a timing belt 54 coupling wheel 53 to another toothed wheel 55 which rotates the draw rolls 28. Coaxial with the toothed wheel 55 and rotating with it is a smaller toothed wheel 56, over which runs a timing belt 57 coupling the wheel 56 with a larger toothed wheel 58 which is rotating the feed rolls 26.

Safeguards can be provided against operator mistakes, such as moving the support unit 16 into its operative position with the belt 40 aligned with the teeth of the wheel 41 and not with the plain portion 46.

For example a catch mechanism could be incorporated which prevents complete or significant movement of the unit 16 towards its inoperative position unless the cam and lever mechanism is operated to shift the belt into alignment with the plain portion 46. Similarly means may be provided to ensure that the operator cannot move the unit 16 into its operative position and leave it with the belt 40 engaging the plain portion 46, omitting to mesh the belt with the teeth by operating the belt-shifter mechanism. For example the unit 16 may be spring-loaded outwardly and needs to be locked in its inward operative position by a releasable latch mechanism, operation of which to lock the unit is not possible unless the belt-shifter mechanism is first operated to mesh the belt 40 with the teeth 41, or the releasable latch mechanism may be connected with the belt-shifter mechanism so that applying the latch mechanism automatically operates the belt-shifter mechanism.

FIG. 5. diagrammatically shows an alternative arrangement to that of FIG. 3. There is the same machine drive shaft 17 carrying a toothed timing belt wheel 41 alongside which is a plain wheel portion 46 of slightly larger diameter. The support unit 16 again consists of a support plate 31 pivoted at 32 to be movable between an operative position shown in full lines and an inoperative position shown in chain-dot lines. The transmission system, which is shown only in part (as in FIG. 2.) again includes a toothed timing belt 40 operating as a coupling member with the toothed timing belt wheel 41 of the machine drive shaft 17. Toothed wheels 59, 60 and 61 over which the belt 40 runs correspond with wheels 34, 35 and 36 of FIG. 2. The belt 40 is always aligned with the teeth of wheel 41 and need not be shifted laterally. The belt 40 runs over two spaced toothed pulleys 62 and 63, each carried by a respective pivot arm 64 and 65. Each arm has a respective loading spring 66 and 67 urging the arms in direction to tension the belt 40, the span of which between the pulleys is presentable to the teeth of the wheel 41.

Coaxial with the toothed pulley 62 and rotating with it is a friction wheel 68, such as a wheel with a rubber tyre, which firstly is of slightly larger diameter than its coaxial toothed pulley 62 and secondly lies in the plane of the plain portion 46 of the toothed timing belt wheel 41. FIG. 5. illustrates how the belt 40 is engaged with the toothed timing belt wheel 41 as the support plate 31 is pivoted inwardly from its inoperative position, shown in chain-dot lines, into its operative position shown in full lines, intermediate positions of the belt 40 and the pulleys 62 and 63 being also shown in broken chain lines. The drawing shows that as the support plate is pivoted inwardly the friction wheel 68 first engages the plain portion 46 of the toothed wheel 41, the span of the belt 40 between the toothed pulleys 62 and 63 still being straight and out of contact with the toothed wheel 41, so that frictional contact between the friction wheel 68 and the plain portion 46 of the rotating toothed wheel 41 causes the pulley 62 to rotate and accelerates the belt 40 up to speed. Further inward pivoting of the support plate 31 engages the belt 40 with the toothed timing belt wheel 41, the belt 40 by then being run up to a speed fractionally faster than the wheel 41 so that their teeth align and interengage readily and the belt is subjected only to slight deceleration rather than any acceleration shock. As the belt and wheel teeth are brought into mesh the friction wheel 68 begins to "walk round" the periphery of the plain wheel portion 46, the spring-loaded pivot arms 64 and 65 accomodating this movement, and also deflection of the belt span between the pulleys 62 and 63 from a straight path. Eventually the pivot arm 64 of the pulley 62 engages a fixed cam member 69 which pivots the arm still further, firstly to lift the friction wheel 68 off the plain portion 46 of the toothed timing belt wheel 41, and secondly to lock the arm against the returning action of the spring 68. Pulley 63 then operates as a belt tensioning pulley, in the "return" run of the belt 40, pulley 62 being desirably locked against any movement attributable to belt tension or belt transmission forces since this pulley 62 is in the "driving" run of the belt 40.

Safeguards can be incorporated to guard against operator errors, such as pivoting the support plate inwardly too rapidly and "crashing" belt 40 against toothed wheel 41 before the belt has run up to speed. A dwell period of a few second is desirable, after friction wheel 68 first contacts plain wheel portion 46, for the belt to run up to speed. Support plate 31 can be arranged to engage an abutment, stop or the like, when or shortly after friction wheel 68 contacts plain wheel portion 46 and before the belt 40 engages toothed wheel 41, this abutment or stop needing to be retracted manually before the support plate 31 can be further pivoted inwardly. This abutment or stop could be prevented from retraction by a catch which is releasable only by inward pivoting of the support plate 31. Alternatively a dashpot mechanism could be included to prevent rapid inward pivoting of support plate 31 through its arc of movement when the friction wheel 68 is engaging plain wheel portion 46.

An operator might move support plate 31 not fully into its operative position, for example leaving friction wheel 68 still in contact with plain wheel portion 46 but with the belt 40 in mesh with toothed wheel 41, which is undesirable, and to prevent this the support plate can be subjected to outward spring-loading or other resilient force urging it towards its inoperative position, sufficiently to bring the belt 40 out of mesh unless the operator has moved support plate 31 fully into its operative position and a releasable latch or catch has been applied, automatically or manually, to hold the support plate 31 in its operative position.

What we claim is:

1. A machine for texturing a plurality of yarns, said machine comprising a frame having a row of processing stations; a rotatable drive shaft extending in said frame past all of said stations and carrying at each station a toothed wheel; a support at each station displaceable between an operative position and an inoperative position; means for texturing a yarn at each station including a plurality of driven members all of which are carried on the respective support; and transmission means on each support positively interconnecting all of the respective driven members and including at least one toothed belt engaging at least some of the respective driven members, each belt being engaged with the respective toothed wheel in the operative position of the respective support and out of engagement with the respective toothed wheel in the inoperative position of the respective support, whereby all of the driven members of a texturing means are disconnected from the drive shaft on displacement of the respective support into the inoperative position.

2. The machine defined in claim 1 wherein each transmission includes a plurality of such toothed belts.

3. The machine defined in claim 1 wherein each wheel has a toothed region and immediately adjacent said toothed region a smooth region, each support being provided with means for displacing the respective toothed belt in the operative position of the support between a positive-coupling position engaging the respective toothed region and a slip-coupling position engaging the respective smooth region.

4. The machine defined in claim 3 wherein each wheel is of a diameter of its smooth region at least as great as its diameter at the outside of its toothed region.

5. The machine defined in claim 1 wherein each wheel has a toothed region and adjacent said toothed region a smooth region, each support being provided with at least one toothed pulley jointly rotatable with a friction wheel engageable with the respective smooth region and with means for automatically displacing said friction wheel into engagement with said smooth region on displacement of the respective support from the inoperative position into the operative position and for displacing said friction wheel out of engagement with the respective smooth portion and displacing the respective toothed belt into engagement with the respective toothed portion on complete engagement of the respective support into its operative position.

6. The machine defined in claim 5 wherein said means for displacing includes a cam fixed on said frame adjacent each station and operatively engageable with the respective friction wheel.

7. The machine defined in claim 1 wherein said transmission includes a toothed idler pulley over which is spanned the respective toothed belt, and means for biasing said toothed idler pulley away from at least some of the respective driven members for maintaining the respective toothed belt tight.

8. The machine defined in claim 1 wherein each support is pivotal on said frame between said positions.

9. A machine for texturing a plurality of yarns, said machine comprising: a frame having a row of processing stations; a single drive element extending in said frame past all of said stations; a support at each station displaceable between an operative position and an inoperative position; means for texturing a yarn at each station including a plurality of driven members all of which are carried on the respective support, one of said driven members on each supports being a pair of feed rollers and another of said driven members on each support being a pair of draw rollers, each said means for texturing including means at said station on said frame and separate from the respective support for heating the respective yarn; and transmission means on each support in intermeshing driving engagement with all of the respective driven members and including at least one coupling member in intermeshing driving engagement with at least one of the respective driven members, each coupling member being engaged with said drive element in the operative position of the respective support and out of engagement with said drive element in the inoperative position of the respective support, whereby all of the drive members of a texturing means are disconnected from the drive element on displacement of the respective support into the inoperative position.

* * * * *